US007040995B2

(12) United States Patent
Lee

(10) Patent No.: US 7,040,995 B2
(45) Date of Patent: May 9, 2006

(54) HANGING CHAIR STAND

(76) Inventor: Benjamin Michael Lee, 4503-18th St., Lubbock, TX (US) 79416

( * ) Notice: Subject to any disclaimer, the term of this patent is extended or adjusted under 35 U.S.C. 154(b) by 0 days.

(21) Appl. No.: 10/701,202

(22) Filed: Nov. 4, 2003

(65) Prior Publication Data

US 2004/0116195 A1 Jun. 17, 2004

Related U.S. Application Data

(60) Provisional application No. 60/428,548, filed on Nov. 21, 2002.

(51) Int. Cl.
*A63G 9/12* (2006.01)

(52) U.S. Cl. ..... 472/118; 5/120; 297/273

(58) Field of Classification Search ..... 472/118, 472/125; 5/120, 127, 128, 129, 130; 297/273, 297/274; 248/163.1, 163.2, 440.1
See application file for complete search history.

(56) References Cited

U.S. PATENT DOCUMENTS

| | | | | |
|---|---|---|---|---|
| 236,630 | A | 1/1881 | Robinson | |
| 459,670 | A | 9/1891 | Barnhart | |
| 505,797 | A | 9/1893 | Wastall | |
| 654,779 | A | 7/1900 | Bowland | |
| 787,556 | A | 4/1905 | Bottgar | |
| 1,456,031 | A * | 5/1923 | Molby | 482/131 |
| 2,398,384 | A | 1/1946 | Meyers | |
| 2,562,022 | A * | 7/1951 | Duer | 248/188.7 |
| 2,728,617 | A * | 12/1955 | Edwards | 384/512 |
| 3,344,443 | A * | 10/1967 | Bounell | 5/120 |
| 3,528,657 | A * | 9/1970 | Krupsky | 472/118 |
| D249,408 | S | 9/1978 | Jackson | |
| 4,478,409 | A | 10/1984 | Eads | |
| 5,097,545 | A | 3/1992 | Hooi | |
| 5,842,741 | A | 12/1998 | Onorini | |
| 6,582,018 | B1 | 6/2003 | Tseng | |

OTHER PUBLICATIONS

Article from www.casualfurniture.org/cfrc/archive.cfm?action, 1 page, Oct. 7, 2002.*
Listing from www.casualliving.com/Archirenews2002.html, 2 pages, Oct. 2002.*
The HammockSource, Hatteras Hammocks, Brochure, 2001, p. 6, the HammockSource, P.O. Box 1602, Greenville, NC 27835 (p. 6 only included).
Jobek, Jobek, Catalog, 2002, p. 76, Jobek, Froschenseestrasse 45, D-87629, Fuessen, Germany (p. 76 only included).
Omni/Swings N' Things, Amazing Hammock Chair, Brochure, 2002, p. 1, Item #510, Conyers, Georgia 30094 (p. 1 only included).
Jobek, Jobek, Catalog, 2002, p. 12, Jobek, Froschenseestrasse 45, D-87629, Fuessen, Germany (p. 12 only included).

(Continued)

*Primary Examiner*—Kien Nguyen

(57) ABSTRACT

According to one embodiment of the invention, Hinging Chair Stand (100), a Hinging Chair Stand includes first and second support members (200 and 202) coupled to one another at the intermediate portion. (210) The support members each have a leg portion (206*a* and 206*b*) that is adapted to rest on a base and an arm portion (204*a* and 204*b*) adapted to suspend a hanging chair over a region defined by the leg portions 220. A pair of attachment members (212) may be coupled to ends of the arm portions to suspend the hanging chair over the region.

2 Claims, 6 Drawing Sheets

OTHER PUBLICATIONS

Jobek, Jobek, Catalog, 2002, p. 49, Jobek, Froschenseestrasse 45, D-87629, Fuessen, Germany (p. 49 only included).

Algoma Net Company, Algoam Hammocks, Catalog, 2003, p. 12 Algoma Net Company, 1525 Mueller Street, Algoma, Wisconsin 54201 (p. 12 only included).

Hammock World, New Hammock Recliner, Internet address: http://www.hammockworld.co.nz/images/ham_rec2-b.jpg, Hammock World, P.O. Box 32-393 Devonport, Auckland, New Zealand (catalog not available).

Benjamin M. Lee, Green Eggs & Hammocks, Catalog, 2003, p. 2, Green Eggs & Hammocks, 4116—34th Street Lubbock, Texas 76410.

* cited by examiner

HANGING CHAIR STAND

CROSS-REFERENCE TO RELATED APPLICATIONS

This application claims the benefit of Provisional Patent Application:

No.: 60/428,548

FILLING DATE: Nov. 21, 2002

NAME OF APPLICANT: Benjamin M. Lee, Lubbock, Tex.

TITLE OF THE INVENTION: Hanging Chair Stand

FEDERALLY SPONSORED RESEARCH

Not applicable

SEQUENCE LISTING OR PROGRAM

Not applicable

BACKGROUND OF THE INVENTION

1. Technical Field of the Invention

The present invention relates generally to the field of the leisure/outdoor furniture industry and, more particularly, to a Hanging Chair Stand.

2. Discussion of Prior Art

Hanging chairs or slings have become popular within recent years. No doubt, when a person hears the phrase "hanging chair," thoughts of rest and relaxation enters the person's mind. Traditionally, hanging chairs include a fabric sling of some kind that is suspended from a single point harness, which is connected to either side of a wood spreader bar that, in turn, is connected to either side of a seat sling. This set-up is suitable where there are pre-existing overhead supports, such as tree limbs or ceiling joists. The installation of these types of hanging chairs takes some skill and is time-consuming. Where no overhead supports are available, hanging chairs may take the form of freestanding hanging chair supports having metal or wooden frames. However, these freestanding hanging chairs are expensive, bulky and can pose safety hazards.

Further Discussion of Prior Art—Non Patent Literature Documents (NPLD)

The earliest freestanding stands, or hanging chair supports, were single point stands. That is, they are designed to hold the chair from a single central suspension point on the highest portion of the Hanging Chair Stand. Single point stands are still the most widely used form of hanging chair stands. Ten or more single point stands can be found on the market today. Several of these stands are illustrated in the excerpts from brochures and catalogs listed as Non Patent Literature Documents (hereafter NPLD) P, Q, R, in the accompanying Form PTO/SB/O8B. These three stands, NPLD P, Q, and R, are representative of prior art single point stands. The stand shown in Illustration NPLD P is probably the most frequently sold single point stand at this time. This stand is in excess of 7 feet tall, weighs about 70 lbs., and is composed of 12 pieces.

More recently a few two point or multi-point hanging chair stands have appeared on the market. These stands are designed to suspend a hanging chair from two or more points on the stand. Only a few of this type of stand can be found on the market today. Four two point stands are illustrated in the excerpts from catalogs and brochures listed as Non Patent Literature Documents (hereafter NPLD) in the accompanying Form PTO/SB/08B. Illustrations NPLD S, T, U, V, illustrate the variety of these stands. This is a representative sample of prior art two point stands. Illustration NPLD U shows a two point stand 412 which is 64" high, 36" wide and 45" long.

As suggested above, the earliest hanging chairs were single point, and were used primarily outdoors, suspended from tree limbs. The earliest hanging chair stands were also used primarily outdoors.

Along with the increasing popularity of hanging chair stands has come the need for a stand that is convenient for indoor use, as well as outdoors. Neither the single point nor the two point prior art stands has adequately satisfied this need. The reasons are various. Almost all have a tripping hazzard. The tripping hazzard stems form a cross member or tie bar immediately below or in front of the location over which the person is suspended when sitting in the hanging chair. Illustrations NPLD P, Q, R, S, T, U, V (reference numerals 502, 504, 506, 508, 510) all show a cross member as part of these prior art stands. Hanging chair stands 406 and 414, Illustrations NPLD R and V, are the only prior art two point hanging chair stands known to the inventor that do not show a cross member. However, even these stands (because of the cross-bars in their square foot prints, 606, 614) have a degree of obstruction not found in the Hanging Chair Stand. A picture of the Hanging Chair Stand can be seen in the inventor's catalog, Illustration W.

Further, Illustrations NPLD P, Q, R, S, T, U, V, which include both the single point and two point stand, show that all prior art stands have a square or rectangular footprint (reference numerals 602, 604, 606, 608, 610, 612, 614). The square footprint limits the areas in which they can be conveniently located indoors, as well as outdoors. This is because their bulky footprints preclude their use in corners and corner-like spaces. Some of the stands are bulky and heavy, some are complicated to assemble. Some tend to come apart when in use. Some tend to tip over too easily when in use.

None of these problems exist with the Hanging Chair Stand, which is a two point stand.

The reason prior art has not solved the cross member and bulky footprint problems with respect to two point stands, is because most developers have failed to look beyond the concept of the full-length hammock support stand. That is, one can easily see from Illustrations NPLD S, T, U, V, that prior art two point stands are merely a version of the full-length hammock support stand. That is, examination of Illustrations NPLD S, T, U, V, show that each of these prior art stands have been made by folding up, or shortening, a full-length hammock support stand, thereby converting it to hold a hanging chair. This still leaves most prior art two point stands with a cross member beneath the feet of the user, and all with a bulky footprint.

Further Discussion of Prior Art—U.S. Patent Documents

U.S. Pat. No. 236,630 to S. R. Robinson discloses a combined chair and hammock, and, as constructed, the chair may be also used for a swing.

U.S. Pat. No. 549,670 to C. L. Barnhart discloses an efficient spring-actuated baby-jumper simple and durable in construction and effective in operation.

U.S. Pat. No. 505,797 to A. Wastall discloses am aerial cradle-cot of the class which possesses the attributes of absolute safety, extreme comfort, general convenience, ready adjustability of parts, lightness, compactness, portability and adaptability for use in or out of doors, on land or shipboard, and in all climates.

U.S. Pat. No. 654,779 to J. Bowland discloses an improved device with a supporting frame which may be conveniently assembled and also taken apart for shipment, and also having improved means for pivotally or hingedly hanging the seat or body of the swing on the frame, so as to obtain a free and easy swinging movement of the seat.

U.S. Pat. No. 787,556 to A. P. Bottgar discloses a swinging chair in which the back of the chair is easily and readily adjustable and also in which the foot-rest is capable of adjustment, and further, provides a swinging chair which can be easily and readily attached to and detached from hooks in the ceiling or the top of a door casing.

U.S. Pat. No. 2,398,384 to A. G. Meyers discloses a nursery chair swing and provides a simple, durable, and attractive article which is readily folded into compact form for convenient storage, when not in use, and readily unfolded into operative form for use.

U.S. Pat. No. Des. 249,408 to William P. Jackson discloses the ornamental design for a "suspension chair and stand."

U.S. Pat. No. 4,478,409 to Thomas C. Eads, et al, discloses a hanging chair including a generally rectangular seat frame and a generally rectangular backrest frame pivotally attached to the seat frame.

U.S. Pat. No. 5,097,545 to Ambrose C. S. Hooi discloses an infant cradle comprising a support stand and a hammock that is suspended from the support stand.

U.S. Pat. No. 5,842,741 to Giorgio Onorini discloses an improved portable patio swing of the type being suspended from a free-standing, overhead support frame.

U.S. Pat. No. 6,582,018 B2 to Chuen-Jong Tseng discloses a swing frame including a pair of support frame units, a hollow horizontal bar, and two primary locking devices.

Through a diligent search of the U.S. PTO records, the above patents cite the most relevant inventions this inventor was able discover, but none of them is very similar to the Hanging Chair Stand.

BACKGROUND—OBJECTS AND ADVANTAGES

Such problems as the cross member bar, bulky footprint, excessive height, weight, and complexity, and the need for a simpler design over prior art stands, led me to invent the Hanging Chair Stand.

The Hanging Chair Stand is designed to allow the seat and the person sitting in it to be suspended over a space defined by the legs of the stand, with no adjoining cross-member (i.e., adjoining leg support) beneath the user. The Hanging Chair Stand is the first two-point stand designed to allow the person sitting in it to be suspended over a space with no adjoining cross-member or other obstruction beneath the user. By contrast, all prior art two point stands known to the inventor suspend the person sitting in the seat directly above a cross member or other obstruction, which is the common denominator of all prior art. Elimination of these obstructions in the Hanging Chair Stand eliminates an awkward obstruction and potential tripping hazard encountered by users of prior art stands.

Examination of the Hanging Chair Stand, FIG. 2, shows that it is a dramatic departure from the concept followed by prior art two point stands. As may be seen from the illustrations, these prior art two point stands are merely a version of the full-length hammock support stand. That is, Illustrations NPLD S, T, U, V, show that these prior art stands have been made by folding up, or shortening, a full-length hammock support stand, thereby converting it to hold a hanging chair. Examination of the Hanging Chair Stand 100 shows that it is not merely a variation on the full-length hammock support stand, as are the prior art stands.

Further, when indoor use is desired and space economy is important, the prior art stands are a poor choice as well. The footprints or base of prior art stands are square or rectangular in shape. This means prior art stands are bulky and awkward, so that they are not very suitable for indoor use. That is, they do not fit conveniently in corners or corner-like spaces. By comparison Hanging Chair Stand 100 has a V-shaped footprint. This configuration uses an economy of space and can be comfortably located in a corner or other small spaces. This makes the stand usable in areas where a square or rectangular stand will not conveniently fit, as is the case with prior art.

Illustrations NPLD P shows the most commonly used single point prior art stand 402. This stand is assembled from 12 pieces and weighs about 70 lbs. This stand tends to come apart when a person sits in the chair. This does not happen to the Hanging Chair Stand because of the strength and security of its connecting portions.

The preferred embodiment hanging chair 100 is comparatively light weight and requires minimal time and effort to assemble. The light weight and compact structure of the hanging chair allows it to be moved easily and to be used in areas not conveniently available to prior art, such as indoor use.

The design of the Hanging Chair Stand eliminates the need for the spreader bar found on all single point hanging chairs. However, many single point hanging chairs are designed in a way that allows the spreader bar to be easily removed, so that these seat slings can easily be attached directly to the arms of the Hanging Chair Stand. Thus the Hanging Chair Stand becomes an attractive alternative to those who may already own a single point hanging chair and yet want to use their chair in the Hanging Chair Stand. Even other common hanging chairs such as illustrated in FIGS. 3A and 3B, which are multi-point slings, can be used in this stand.

The preferred embodiment of the Hanging Chair Stand 100 has another advantage which is readily apparent to the viewer. FIG. 1 illustrates the unique shape and curvaceous support arms and legs seen in the V-shaped Hanging Chair Stand 100, which components are graceful and aesthetically beautiful. None of the prior art two-point stands follows this concept. One can easily see from the Illustrations NPLD S, T, U, V, that prior art, two point hanging chair stands are merely a folded up, or shortened version of a full-length hammock support stand.

Because of the simplicity of design and construction of the Hanging Chair Stand, it can be produced more economically than other two-point hanging chair stands.

Other objects and advantages of the Hanging Chair Stand will become apparent from the drawings and ensuing description.

SUMMARY OF THE INVENTION

According to one embodiment of the invention, a Hanging Chair Stand includes first and second support members coupled to one another at an intermediate portion. The support members each have a leg portion that is adapted to rest on a base and an arm portion adapted to suspend a hanging chair over a region defined by the leg portions. A pair of attachment members may be coupled to ends of the arm portions to suspend the hanging chair over the region.

Embodiments of the invention provide a number of technical advantages. Embodiments of the invention may include all, some, or none of these advantages. A Hanging Chair Stand according to an embodiment of the present invention facilitates a comfortable hanging chair that requires minimal installation. The structure contemplates no awkward obstruction or potential tripping hazard below the seat area. In addition, it saves considerable space, especially in corner-like areas, which is important when using indoors. A Hanging Chair Stand according to an embodiment of the present invention is also inexpensive and can be adapted to suspend four and six point slings. Accessories can also be easily added.

Other technical advantages are readily apparent to one skilled in the art from the following figures, descriptions, and claims.

DRAWINGS—BRIEF DESCRIPTION OF FIGURES

For a more complete understanding of the invention, and for further features and advantages, reference is now made to the following description, taken in conjunction with the accompanying drawings, in which:

FIGS. 4A through 4K illustrate different embodiments of a Hanging Chair Stand in accordance with various embodiments of the present invention.

DRAWINGS AND ILLUSTRATIONS—LIST OF REFERENCE NUMERALS

Figure 1:
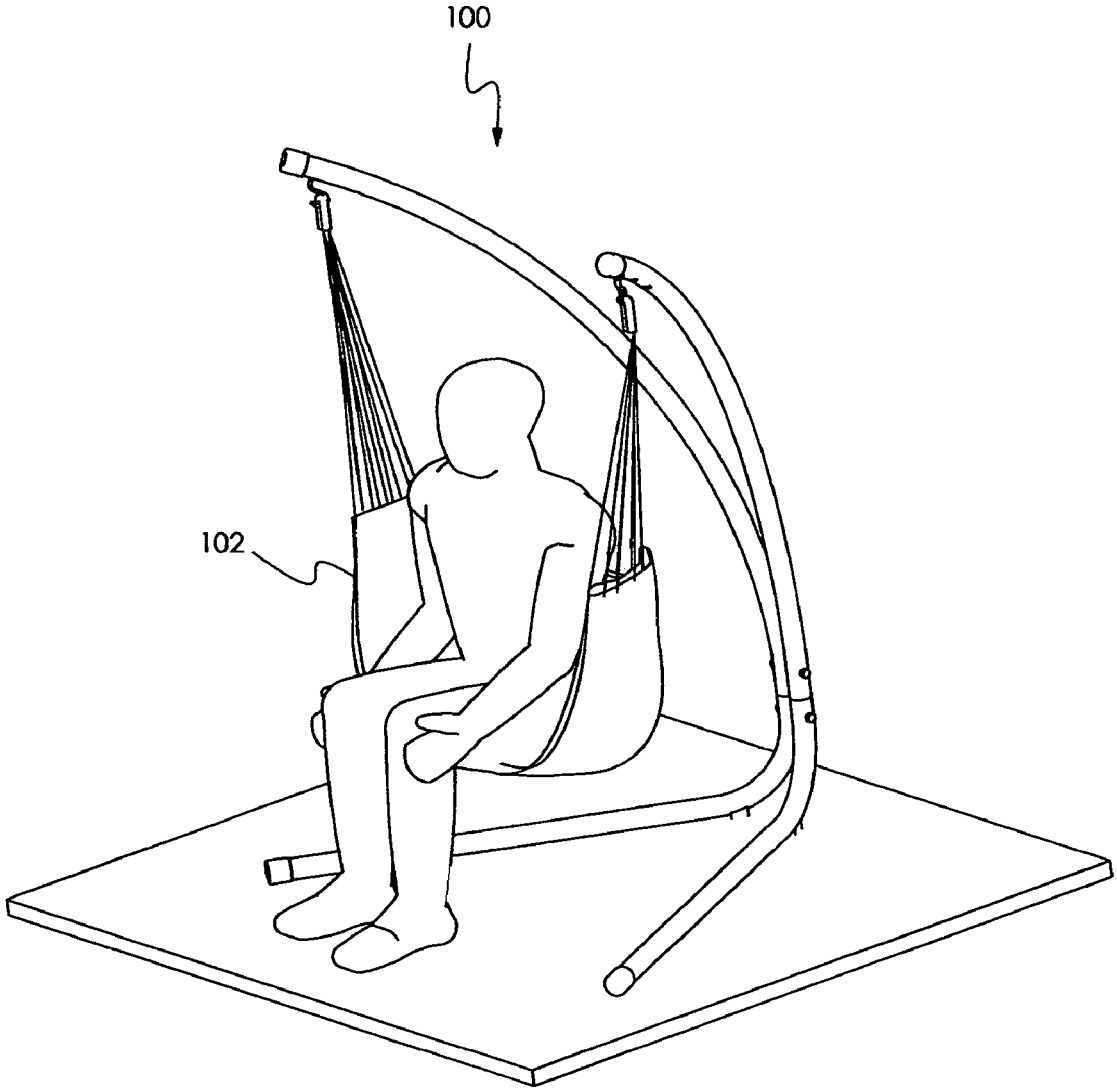
FIG. 1 is a perspective view of a Hanging Chair Stand suspending a person in a fabric seat sling according to one embodiment of the present invention.

100 perspective view of Hanging Chair Stand
102 fabric seat sling
200 first support member
202 second support member
204*a* arm portion
204*b* arm portion
206*a* leg portion
206*b* leg portion
208*a* intermediate portion
208*b* intermediate portion
211 apertures
214 cushion members
216 wheels
218 an imaginary line
220 a region over which a hanging chair is suspended
300 four point sling
302 six point sling
402 Illustrates Non Patent Literature Documents (hereafter, NPLD) P
404 Illustration NPLD Q
406 Illustration NPLD R
408 Illustration NPLD S
410 Illustration NPLD T
412 Illustration NPLD U
414 Illustration NPLD V
502 cross member or tie bar
504 cross member or tie bar
506 cross member or tie bar
508 cross member or tie bar
510 cross member or tie bar
602 square or rectangular footprint
604 square or rectangular footprint
606 square or rectangular footprint
608 square or rectangular footprint
610 square or rectangular footprint
612 square or rectangular footprint
614 square or rectangular footprint

DETAILED DESCRIPTION

Example embodiments of the present invention and their advantages are best understood by referring now to FIGS. 1 through 4N of the drawings, in which like numerals refer to like parts.

Figure 2:
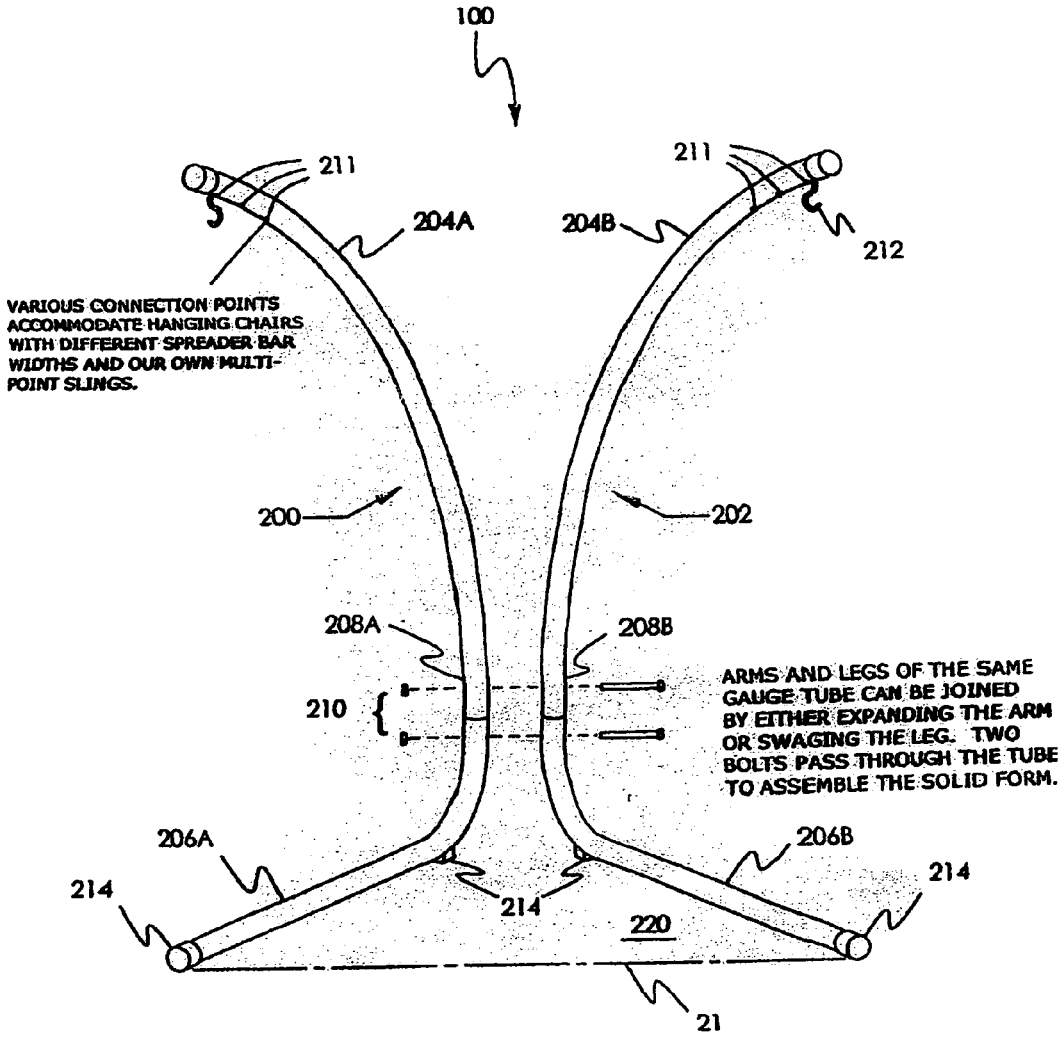
FIG. 2 is an elevation view of the Hanging Chair Stand of FIG. 1 according to one embodiment of the present invention.

Description—Preferred Embodiment—FIGS. 1 and 2

FIG. 1 is a perspective view of a Hanging Chair Stand 100 suspending a person in a fabric seat sling 102 according to one embodiment of the present invention. Hanging Chair Stand 100, the details of which are described below in conjunction with FIG. 2, facilitates a comfortable hanging chair that requires minimal installation. Hanging Chair Stand 100 takes up minimal space as compared to previous hanging chair stands, which may be very important when using a hanging chair indoors. Hanging Chair Stand 100 is easily adaptable to various types of seat slings 102.

Referring to FIG. 2, an elevation view of Hanging Chair Stand 100 is illustrated. In the illustrated embodiment, Hanging Chair Stand 100 includes a first support member 200 and a second support member 202. Support member 200, 202 each include an arm portion 204*a*, 204*b*, a leg portion 206*a*, 206*b* and an intermediate portion 208*a*, 208*b*. Support members 200, 202 are coupled to one another at intermediate portions 208*a*, 208*b* with one or more fasteners 210. Support members 200, 202 may be formed from any suitable material; however, in one embodiment, support members 200, 202 are formed from metal tubing. Arm portions 204*a*, 204*b*, leg portions 206*a*, 206*b*, and intermediate portions 208*a*, 208*b* may be formed integral with one another or may be separate pieces or any combination thereof. Preferably, intermediate portions 208*a*, 208*b* are formed integral with leg portions 206*a*, 206*b*, while arm portions 204*a*, 204*b* are separate members.

Arm portions 204*a*, 204*b* may have any suitable shape; however, in the illustrated embodiment arm portions 204*a*, 204*b* have a curved shape and flare out from intermediate portions 208*a*, 208*b* to form a general V-shape. A plurality of apertures 211 may be formed in each arm portion 204*a*, 204*b* to accept one or more attachment members 212 for the purpose of suspending a hanging chair, such as hanging chair 102, from arm portions 204*a*, 204*b*. Attachment members 212 may be any suitable attachment members such as S-hooks. Ends of arm portions 204*a*, 204*b* may be spaced apart at any suitable distance; however, a typical distance between ends of arms portions 204*a*, 204*b* is three to six feet.

Leg portions 206*a*, 206*b* are substantially straight members that are adapted to rest on any suitable base. However, leg portions 206*a*, 206*b* may be any suitable shape. Leg portions 206*a*, 206*b* may have one or more cushion members 214 coupled thereto. Cushion members 214 function to prevent leg portions 206*a*, 206*b* from directly engaging a base. This is particularly advantageous when leg portions 206*a*, 206*b* are formed from metal. Leg portions 206*a*, 206*b* and an imaginary line 218 from a region 220 over which a hanging chair is suspended from the ends of arm portions 204*a*, 204*b*. Although ends of leg portions 206*a*, 206*b* may be separated by any suitable distance, typically the ends of leg portions 206*a*, 206*b* will be separated at a distance from three to six feet.

Figure 3A:
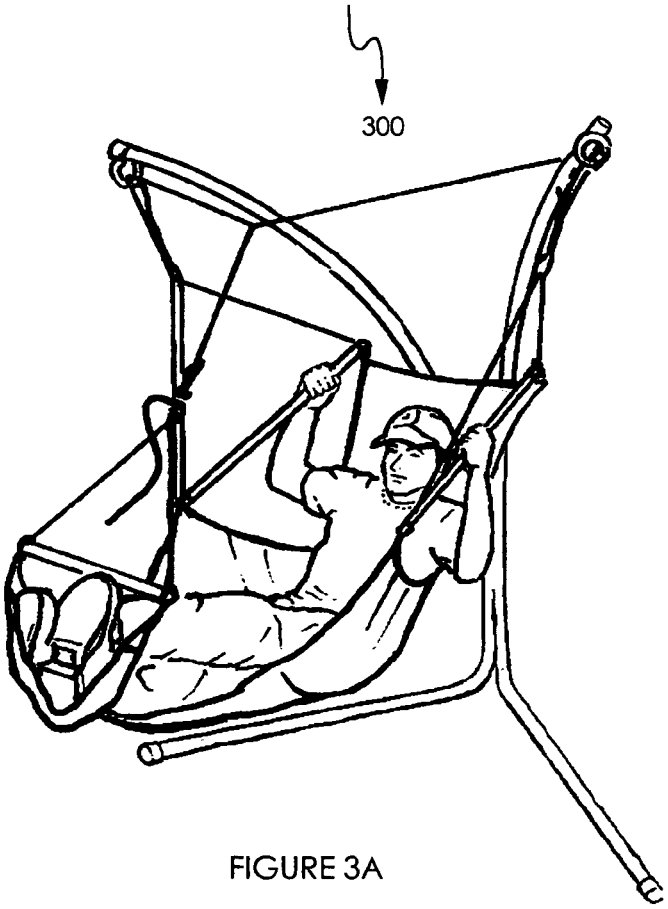
FIGS. 3A and 3B illustrate four-point and six point slings, respectively that may be used with a Hanging Chair Stand according to various embodiments of the present invention.
Figure 3B:
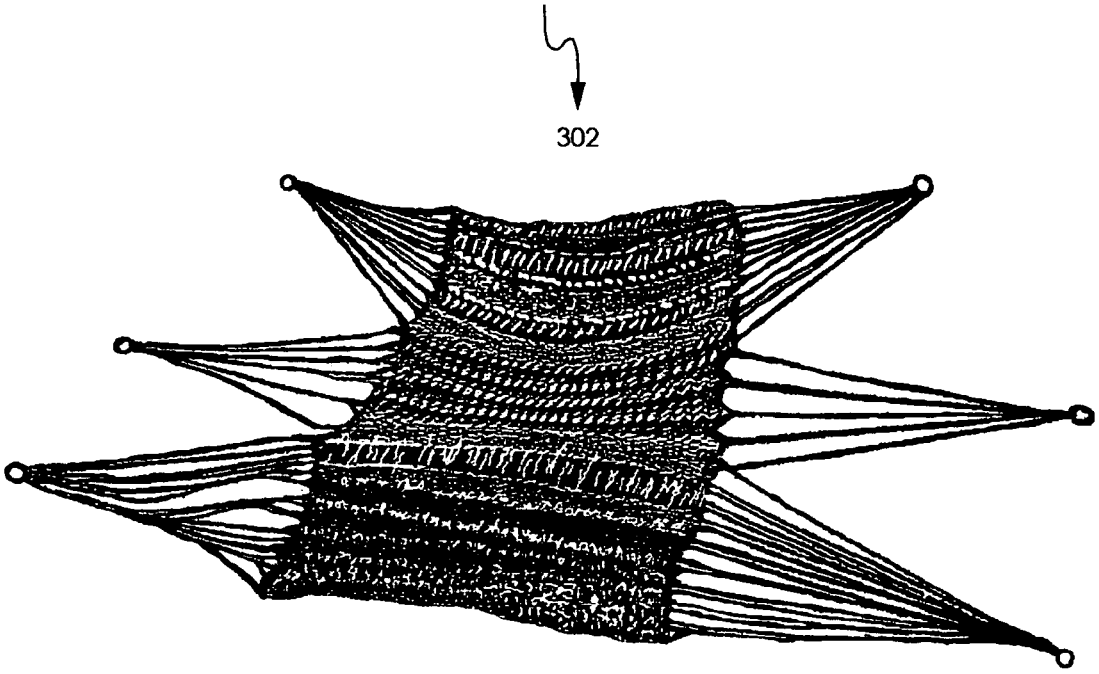

FIGS. 3A and 3B illustrate four-point and six-point slings, respectively, that may be used with Hanging Chair Stand 100. Because arm portions 204*a*, 204*b* are typically formed with multiple apertures 211 for accepting connectors of a seat sling, Hanging Chair Stand 100 is easily adaptable to four-point sling 300 and six-point sling 302. Having apertures 211 formed along the length of arm portions 204*a*, 204*b*, allows Hanging Chair Stand 100 to be easily adaptable to different types of slings and allow any one seat sling to easily change reclining positions.

Figure 4A:
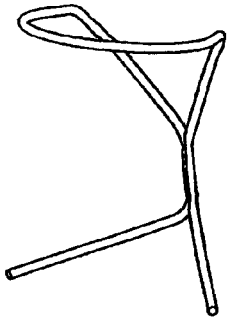
Figure 4D:
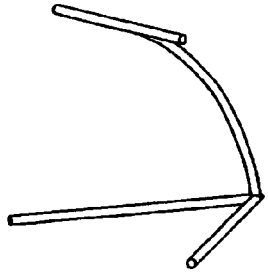
Figure 4B:
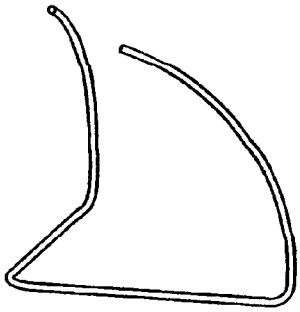
Figure 4E:
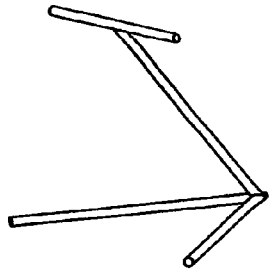
Figure 4C:
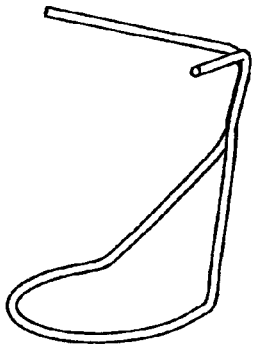
Figure 4F:
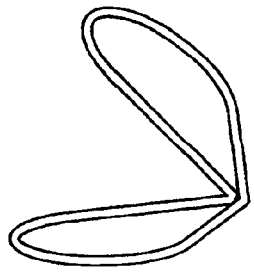
Figure 4G:
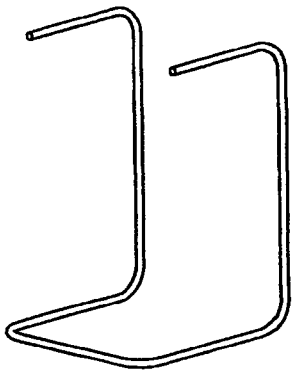
Figure 4K:
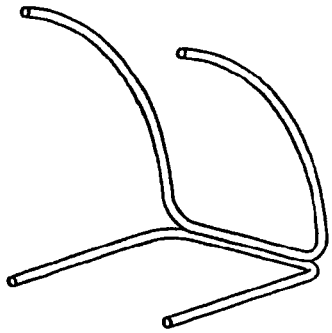
Figure 4H:
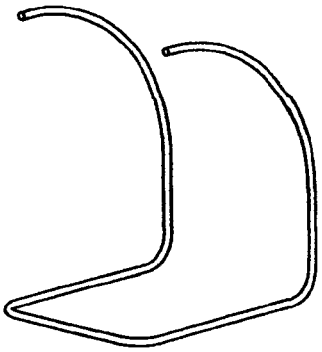
Figure 4J:
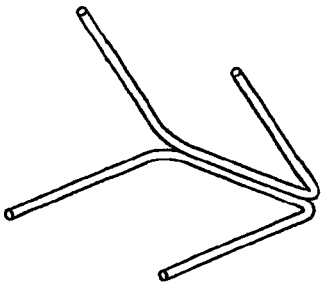
Figure 4L:
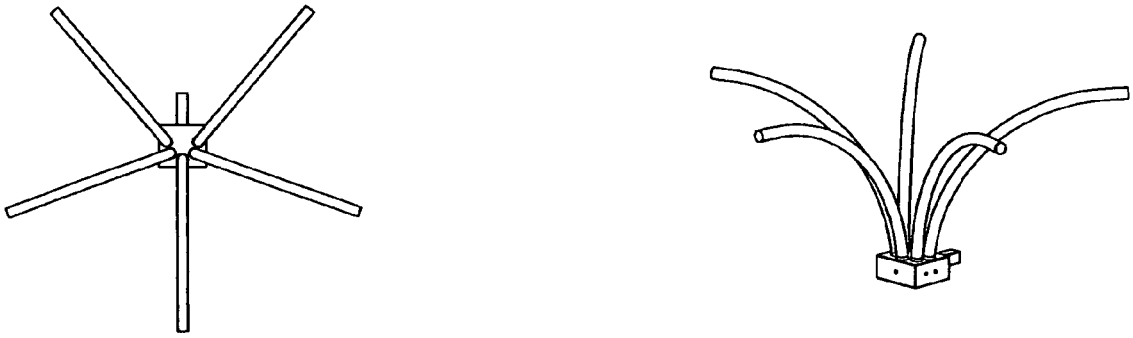
FIGS. 4L through 4N illustrate that multiple copies of hammock chair 100 is part of a hanging chair system.
Figure 4M:
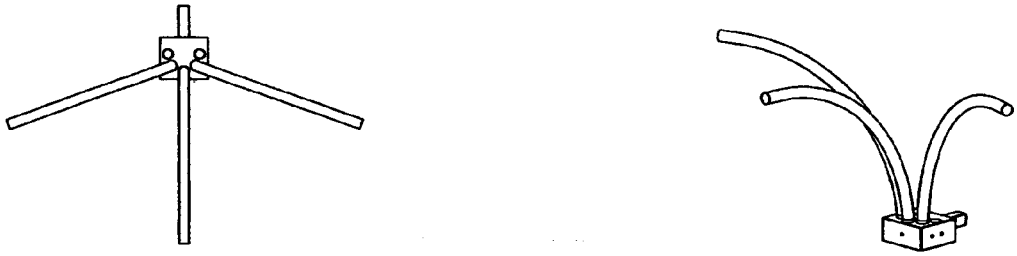
Figure 4N:
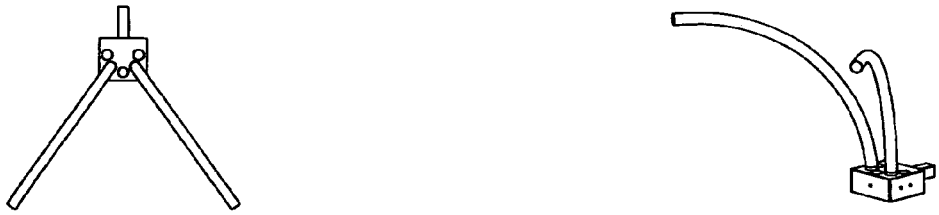

Description—Additional Embodiments & Ramifications—FIGS. 4A–4N

FIGS. 4A through 4K illustrate different embodiments of Hanging Chair Stand 100 in accordance with various embodiments of the present invention. Each of the hanging chair stands illustrated in FIGS. 4A through 4K may be formed from a single part or may be formed from multiple parts. In addition, the hanging chair stands illustrated in FIGS. 4A through 4K are similar to Hanging Chair Stand 100 illustrated in FIG. 2 in that apertures may exist to hang seat slings and leg portions may have cushion members and/or wheels.

The present invention also contemplates other shapes and configurations of Hanging Chair Stand 100 than those shown in FIGS. 4A through 4K. For example, a plurality of the embodiment of Hanging Chair Stand 100 can be assembled side-by-side to form a hanging chair system. That is, a plurality of Hanging Chair Stands 100 can be anchored together at intermediate points 208*a*, 208*b*, in a star-like configuration, or as if circumscribed by an imaginary circle. Further, FIG. 4L illustrates that a similar configuration can be created by using only the upper portions of the support members 208*a*, 208*b*. That is, a plurality of support members of Hanging Chair Stand 100 are truncated at intermediate points 208*a*, 208*b*. The remaining arm portions 204*a*, 204*b* are affixed to a base plate at intermediate points 208*a* and 208*b*, with the supporting arms flaring out from the center of the plate to form a star-like or circular configuration. FIGS. 4M and 4N illustrate that consistent with this arrangement, mere segments of this circle or system can be used in various ways. For example, two or three supporting members are affixed to a base plate, and then can be used to support one or two hanging chairs in different ways and places.

Description—Operation—FIGS. 1, 3A, 3B

FIGS. 1, 3A and 3B illustrate that the various embodiments of Hanging Chair Stand 100 can be used to accommodate hanging chairs suspended from two, four, six or more aperture locations on the arms of the chair 211. Thereby the stand can be made to allow for any upright or reclining position. Thus the sling can be used for sitting, or for full-body laying. The light weight and compact structure of the hanging chair allows it to be easily moved and to be used in areas not conveniently available to prior art, such as indoor use.

FIG. 1 illustrates that the arms of the Hanging Chair Stand 100 arch higher than the head of the person sitting or reclining in the chair, yet the arms of the stand are conveniently within reach of the user. This configuration provides various functional advantages. The user can grasp the arms to lift himself up to adjust his position in the chair, or to perform upper-body exercise by raising and lowering himself while in the chair, or to push himself to enjoy the swinging motion of the chair.

A further use of the preferred embodiment of the stand 100 derives from its graceful beauty and multiple colors. It can be used to adorn the den, the patio, the swimming pool, or the beach as well as to enhance leisure moments by relaxing in the chair.

Description—Conclusion, Ramifications, and Scope

Thus the reader will see that the Hanging Chair Stand provides a highly reliable, lightweight, economical, comfortable, yet aesthetically appealing piece of indoor and outdoor leisure furniture.

FIGS. 4A–4N illustrate that the simplicity of the design of the Hanging Chair Stand 100 suggests various ramifications.

Although embodiments of the invention and some of their advantages are described in detail, a person skilled in the art could make various alterations, additions, and omissions without departing from the spirit and scope of the present invention as defined by the appended claims.

Accordingly, the scope of the invention should be determined not by the embodiments illustrated, but by the appended claims and their legal equivalents.

What is claimed is:

1. A Hanging Chair Stand, comprising:

first and second support members each having an arm portion, a leg portion and an intermediate portion, the first and second support members coupled to one another at their intermediate portions;

the leg portions being substantially straight and adapted to rest on a base;

when resting on the base, the leg portion above which a hanging chair is to be suspended from an end of each arm portion;

the arm portions each having a curved shape and a plurality of apertures formed on each arm portion, the apertures adapted to accept connectors or attachment members for hanging the hanging chair; and a pair of attachment members coupled to the ends of the arm portions, the attachment members adapted to suspend the hanging chair over the region defined by each leg portion and the imaginary line connecting the end of each leg portion.

2. The Hanging Chair Stand of claim 1, wherein the attachment members are S-hooks.

* * * * *